US007733208B2

(12) United States Patent
Wolfgram

(10) Patent No.: US 7,733,208 B2
(45) Date of Patent: Jun. 8, 2010

(54) HIGH VOLTAGE PULSE TYPE TRANSFORMER WITH INCREASED COUPLING COEFFICIENT THROUGH PRIMARY AND SECONDARY WINDING PROXIMITY

(75) Inventor: Kirk W. Wolfgram, Rochester, MN (US)

(73) Assignee: Wolfgram Industries, Inc., Rochester, MN (US)

( * ) Notice: Subject to any disclaimer, the term of this patent is extended or adjusted under 35 U.S.C. 154(b) by 213 days.

(21) Appl. No.: 12/148,500

(22) Filed: Apr. 21, 2008

(65) Prior Publication Data

US 2009/0261934 A1 Oct. 22, 2009

(51) Int. Cl.
*H01F 27/30* (2006.01)

(52) U.S. Cl. ..... 336/208; 336/207

(58) Field of Classification Search ..... 336/208
See application file for complete search history.

(56) References Cited

U.S. PATENT DOCUMENTS 5,764,124 A * 6/1998 Nakamichi et al. ..... 336/92

6,404,316 B1 * 6/2002 Busletta et al. ..... 336/198

* cited by examiner

*Primary Examiner*—Elvin G Enad
*Assistant Examiner*—Joselito Baisa

(57) ABSTRACT

The present invention provides a high voltage, step-up, high current DC pulse type transformer with increased coupling coefficient between the primary and secondary windings through close proximity of the primary winding turns and secondary winding turns by means of transformer construction that provides a plurality of winding bays for a high voltage secondary winding physically located in close proximity to the primary winding. The plurality of winding bays for the secondary winding are provided by means of a frame and separate thin insulation layer where the thin insulation layer provides the barrel for all or part of the secondary winding. The invention significantly increases the transformer's coupling coefficient in high voltage step-up transformer applications where the transformer's core is pushed beyond saturation due to the high peak current typically found in capacitive discharge type circuits such as those used in electric fence controllers, strobe circuits, and high performance ignition systems for automobile, marine, or motorcycle engines.

6 Claims, 10 Drawing Sheets

HIGH VOLTAGE PULSE TYPE TRANSFORMER WITH INCREASED COUPLING COEFFICIENT THROUGH PRIMARY AND SECONDARY WINDING PROXIMITY

FIELD OF INVENTION

The present invention relates to a high voltage, step-up, high current DC pulse type transformer for use in a high current pulse type application such as a capacitive discharge type circuit where the core is pushed beyond saturation and where the coupling coefficient becomes significantly dependent on the primary winding's physical proximity to the secondary winding, and in particular, a transformer construction that includes a frame for providing a plurality of winding bays for a high voltage secondary winding physically located in close proximity to the primary winding by means of a separate thin insulation layer that provides a barrel to wind the secondary winding.

BACKGROUND OF THE INVENTION

Transformers are electrical devices commonly used to transform power from an AC source to an AC load. They may also be used to electrically isolate the supply from the load by providing adequate insulation and creepage distance between the primary and secondary windings to electrically isolate one winding from the other. Transformers may also be used to generate high voltage and are called step-up type transformers when used to increase voltage on the secondary winding as related to the primary winding. Transformers consist of an input or primary winding, an output or secondary winding, and a means of magnetically coupling the primary winding to the secondary winding through a magnetic material called a core and/or through the air. The primary and secondary windings are typically wound using wire called magnet wire which consists of a conductive wire with a thin insulated coating to keep adjacent winding turns from shorting together. The relationship between the input power to the primary winding and output power from the secondary winding is referred to as the coupling coefficient. The coupling coefficient can be varied through several parameters including change in the transformer's core material or core size, change in winding material, change in the number of winding turns or size of the wire used for the winding. While the effect on the coupling coefficient is minimal in almost all types of transformers, the coupling coefficient can also be changed through proximity of the primary windings to the core, proximity of the core to the secondary windings, and through proximity of the primary windings to the secondary windings. Transformers are typically referred to as AC devices but can be used in a DC pulse application where an electric pulse into a transformer's primary winding causes a change in the magnetic field allowing the transformer to function.

In DC pulse applications, the transformer is typically constructed with a magnetic core and the transformer behaves similar to the AC application provided the pulse current does not become so high the magnetic core is pushed beyond saturation. Pushing the transformer's core beyond saturation in DC pulse type applications such as DC to DC converters is not common because it causes the transformer to become inefficient and results in over-heating. However, in high current DC pulse type applications such as capacitive discharge circuits, saturation of the core is common provided the duration of input pulse current is small relative to the time between the pulses. The relation between the duration of input pulse current to time between input current pulses is called the duty cycle. AC transformers that operate continuously have a duty cycle of 100%. A DC pulse type transformer used in a high current application where there is a long time between the pulse currents (typically while a capacitor is charging) relative to the duration of the pulse current (or during the capacitor's discharge), the duty cycle would be significantly lower than 100%. Due to the lower duty cycle, a transformer used in a high current DC pulse type application has time to cool between pulses and can be significantly smaller than a transformer designed to deliver the same peak output power continuously at a 100% duty cycle. The smaller size and the high currents associated with capacitive discharge type circuits cause the high current DC pulse type transformer's magnetic core to become saturated such that very little increase in output power from the secondary winding is delivered for an increase in input power to the primary winding due to the transformer's magnetic coupling through the transformers magnetic core.

While the magnetic coupling becomes a limiting factor the farther and farther the core is pushed beyond saturation, other changes can be made in the transformer's construction such as the physical proximity of the primary windings in relation to the secondary windings to increase the coupling coefficient and improve efficiency. The farther the transformer's core is pushed beyond saturation, the more dependent the coupling coefficient becomes on the primary and secondary winding's proximity to each other.

Transformers are typically constructed using one of two construction methods, stick wound construction or bobbin construction. The stick wound construction typically consists of an insulated rectangular core tube (typically cardboard) with multiple layers of windings wound around the core tube with a layer of insulation between each layer of windings. Both the primary and secondary windings are typically wound in several layers and separated from each other by a layer of insulation where all the primary winding layers are either inside or outside all of the secondary winding layers. Depending on the dielectric requirements between the primary and secondary windings and between each layer of windings within the primary and secondary, insulation between any two winding layers using materials that are commonly available may be a couple or few thousandths of an inch thick and can be a thin as 0.001 inches. In addition to providing insulation, the layers of insulation function as a mechanical form to keep the windings in layers and in position such that the transformer windings keep their shape and do not fall apart.

After the windings are wound, the coil must be lead-set which consists of finding the ends of the wires between the layers of insulation, pulling the ends of the wires out of the coil, placing insulated tubes over the wires, striping the insulated coating off the ends of the magnet wire, and terminating the ends of the wires. This lead-setting is a labor intensive and expensive process for one primary winding and one secondary winding where both ends of both windings are lead-set. To increase the coupling coefficient, the primary and secondary windings can be wound in alternating layers where multiple layers of primary windings are used to separate multiple layers of secondary windings resulting in a closer proximity between the primary winding turns and secondary winding turns. However, the number of wire ends that need to be lead-set goes up with the number of windings along with the cost.

In step-up transformers used to generate high voltage, the number of layers of secondary windings increases due to the increase in the number of turns in the secondary winding along with the number of layers of insulation necessary between the secondary winding layers. Without the use of multiple layers of primary windings separating multiple layers of secondary windings, the typical construction with all the primary winding layers inside or outside all of the secondary winding layers results in the insulation between all the layers of the secondary winding layers separating each secondary layer farther and farther as each layer moves away from the primary winding. While the secondary winding layer closest to the primary winding is separated from the primary winding by one layer of insulation, the second closest secondary winding layer is separated by two layers of insulation, the third closest secondary winding layer by three layers, and so on. This cumulative number of insulation layers between the secondary winding layers that are farthest away from the primary winding results in an average distance between the primary winding turns and secondary winding turns that significantly limits the coupling coefficient of the transformer when the transformer is used in a high current pulse type application where the transformer's core is pushed beyond saturation and where the coupling coefficient becomes more and more dependent on the primary and secondary winding's proximity to each other.

The bobbin construction transformer consists of a bobbin used as a form for the windings to be wound around rather than the core tube. The bobbin is typically injection molded and includes a round or rectangular tube (called a barrel) with a wall at each end (called a flange). The winding turns are wound around the outside perimeter of the bobbin's barrel between the flanges in an area called a winding bay. The bobbin's barrel and flanges create the structure for the windings to keep a particular shape and allow for multiple layers of windings without insulation between the layers as in the stick wound construction. The bobbin may be provided with pins or connectors for winding machines to wrap both ends of the wires around and terminate the wires, eliminating the lead-setting operation and associated labor costs. In high voltage step-up transformers requiring a high number of secondary turns where the transformer's secondary output voltage potential is higher than the dielectric strength of the coating on the magnet wire used for the secondary winding, the bobbin is typically provided with multiple winding bays to divide secondary output voltage between several winding bays, each winding bay able to withstand part of the secondary winding's total output voltage potential. The multi-winding bay bobbin provides a cost-effective manufacturing construction without the labor intensive costs associated with the stick wound construction.

The bobbin construction transformer can be constructed for a high voltage application using a single bobbin, where the primary and secondary windings are provided side-by-side on the same bobbin, where the bobbin is provided with a flange between the primary and secondary windings, and where the secondary is provided in multiple winding bays. However, this single bobbin side-by-side coil construction causes a significant separation between several of the primary winding turns and most of the secondary winding turns resulting in an extremely inefficient transformer the transformer is a high voltage, high current DC pulse type transformer where the core is pushed beyond saturation.

To place more secondary winding turns in close proximity to the primary winding turns, two bobbins are typically used where the primary winding is wound on one bobbin, the secondary winding is wound on a second bobbin that provides multiple winding bays, and one bobbin and winding are placed inside the other bobbin and winding. While the multiple winding bays for the secondary winding allow the secondary winding turns to be in close proximity to each other, the barrel of the bobbin used for the winding on the outside results in the primary and secondary windings being physically separated by the thickness of the barrel. The most common material used to injection mold bobbins is nylon which requires a wall section of approximately 1/32 inches thick to mold. Materials other than nylon are available to injection mold bobbins, however, these materials cost much more and still require thicknesses close to nylon or must be molded using a wall section thicker than nylon. In addition to the thick insulation associated with the dual bobbin construction that physically separate the primary and secondary winding turns from each other, additional distance is required between the primary and secondary windings due to assembly purposes. To allow assembly of one bobbin over the other bobbin after the winding on the inside bobbin is wound, typically 0.005 to 0.010 inches is required between the inside of the outer bobbin and the outside of the coil on the inner bobbin adding to the distance physically separating the primary and secondary windings.

In the high voltage, high current DC pulse type transformer where the core is pushed beyond saturation and where the primary winding's turns physical proximity to the secondary winding turns becomes more critical for a high coupling coefficient, both the stick wound and bobbin constructions have distinct advantages and disadvantages. While the stick wound construction may use insulation films as thin as 1/1000 inches between each of the winding layers and allow some of the primary winding layers to be in close proximity to some of the secondary winding layers, the high number of secondary winding layers and the insulation required between each layer necessary for the construction results in a significant separation between several of the primary winding turns and the secondary winding turns unless multiple primary winding layers are used to separate the layers of the secondary winding. While the bobbin construction eliminates the need for the multiple layers of insulation between each winding layer, the number of winding bays necessary for a high voltage secondary winding on the same bobbin as the primary winding results in a significant separation between the primary winding turns and secondary winding turns. Even in the dual bobbin construction with one bobbin over the other bobbin, while more secondary winding turns are in close proximity to the primary winding turns, the primary and secondary windings are separated by the thickness of the barrel of the outside bobbin plus additional distance necessary for assembly purposes. Thus it would be beneficial to provide a high voltage, high current, DC pulse type transformer where the core is pushed beyond saturation with a secondary winding provided in a plurality of winding bays as in the bobbin construction and with the primary and secondary windings in close proximity to each other separated by only a thin layer of insulation as in the stick wound construction.

SUMMARY OF THE INVENTION

The present invention provides a high voltage, high current, DC pulse type transformer for use in a high current pulse type circuit such as a capacitive discharge circuit where the core is pushed beyond saturation, with a transformer construction that increases the transformer's coupling coefficient through close proximity of the primary winding turns to the secondary winding turns. The transformer construction includes a primary winding wound around a bobbin with the secondary winding provided in a plurality of winding bays wound around the primary winding. The winding bays are provided by a frame with flanges to separate each of the winding bays while the close proximity of primary winding turns to the secondary winding turns is provided by means of a separate thin insulation layer over the primary winding which is used as the barrel for the secondary winding. The thin insulation layer is provided in least one of the secondary winding bays and separates the primary and secondary windings along a significant distance around the perimeter of the barrel used for the secondary winding. The frame in combination with a thin insulation layer provides a thin insulation layer between the primary and secondary winding, a plurality of winding bays for a high voltage secondary winding, and a significant reduction in separation between the primary winding turns and secondary winding turns as compared to existing bobbin or stick wound construction transformers.

The bobbin for the primary winding eliminates the need for any insulation between layers of the primary winding. The frame used to provide multiple winding bays eliminates the need for insulation between layers of the secondary winding and allows the secondary winding turns to be in close proximity to each other making the secondary winding small and compact relative to a stick wound construction. The thin insulation used for the secondary winding's barrel between the primary and secondary windings allows each of the primary winding turns to be in closer proximity to each of the secondary winding turns as compared to existing transformer constructions resulting in a significant increase in the transformer's coupling coefficient compared to that of transformers using an existing transformer construction.

The frame used to provide the plurality of winding bays for the secondary winding is similar to a multi-winding bay bobbin that fits over the primary winding wound on a separate bobbin but with a barrel that is eliminated or exists only in part along the inside of the secondary winding's inside winding perimeter allowing the secondary winding to be wound directly over the thin insulation layer over the primary winding along part or all of the secondary winding's winding perimeter. Depending on dielectric requirements of each winding bay relative to the primary winding, the frame may include one or more winding bay with a complete barrel where only part of the winding bays allow the secondary winding to be wound directly over the thin insulation layer over the primary winding. Also depending on dielectric requirements of each of the winding bays, the flanges of some or all of the winding bays may exist only in part along part of the secondary winding's winding perimeter allowing windings from adjacent winding bays to contact each other.

The thin insulation layer provided between the primary and secondary windings is a self-adhesive polymeric film such as mylar tape ranging in thickness from 1/1000 inch to several thousandths of an inch thick depending on the dielectric requirements between the primary and secondary windings. However, the thin insulation layer could be comprised of paper or another type of thin film insulation available in the transformer industry and need not be self-adhesive. The thin insulation layer could also be comprised of multiple layers of a thinner material, for example, three layers of material each 2/1000 of an inch thick instead of one layer of a material 6/1000 of an inch thick. In addition to the thin film insulation available in the transformer industry, the thin insulation layer could also be comprised of a coating such as varnish or conformal available in the transformer industry where the coating is provided over the primary winding.

DETAILED DESCRIPTION OF THE INVENTION

Figure 1:
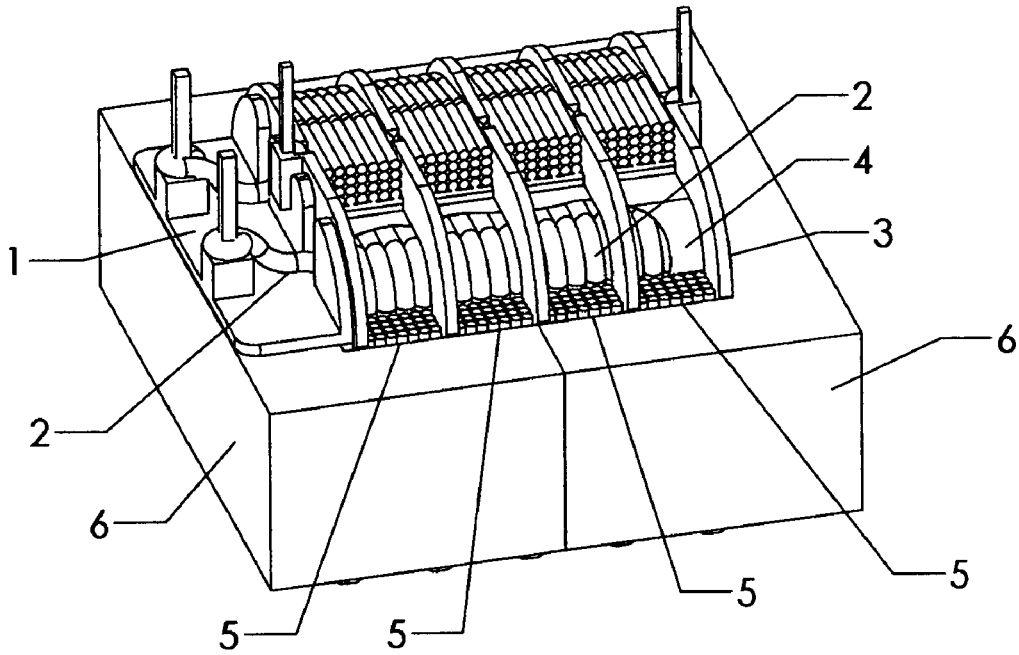
FIG. 1 is an isometric view of a preferred embodiment of the invention showing the frame providing a plurality of winding bays with a high voltage second winding (cutaway), the separate thin insulation layer (cutaway) providing the barrel for the secondary winding, and the primary winding in close proximity to the secondary winding.

FIG. 1 is an isometric view of a preferred embodiment of the high voltage, step-up, high current DC pulse type transformer invention that increases the coupling coefficient through close proximity of the primary winding turns and secondary winding turns. In FIG. 1, a completely assembled transformer is shown with a bobbin 1, a primary winding 2, a frame 3 and separate thin insulation layer 4 combined to provide a form for winding the secondary winding 5 in close proximity to the primary winding 2. Both the primary winding 2 and secondary winding 5 are constructed using magnet wire commonly found in the transformer industry. The secondary winding 5 has an output voltage potential that is greater than the primary winding 2 such that the transformer is considered a step-up type transformer and the secondary winding 5 is a high voltage winding of sufficient output voltage potential to cause breakdown in the coating on the magnet wire used for the secondary winding 5 if the secondary winding is not provided with a means to distribute the output voltage potential such as distributing the output voltage between multiple winding bays or distributing the output voltage between multiple winding layers with insulation between each winding layer. Also shown in FIG. 1 is a typical transformer core 6 comprised of two "E" shaped parts assembled with the center leg of each "E" shaped part inserted into the openings at each end of the bobbin 1 such that the center leg of the "E" is physically located inside the primary winding 2 and secondary winding 5 and common to both windings. The transformer core 6 is comprised of steel or ferrite or any other magnetic material common in the transformer industry. The primary winding 2 is for connection to a typical high current DC pulse type circuit (not shown) such as a capacitive discharge type circuit where the peak DC pulse current is significantly higher than the peak DC pulse current level needed to saturate the core 6.

Figure 2:
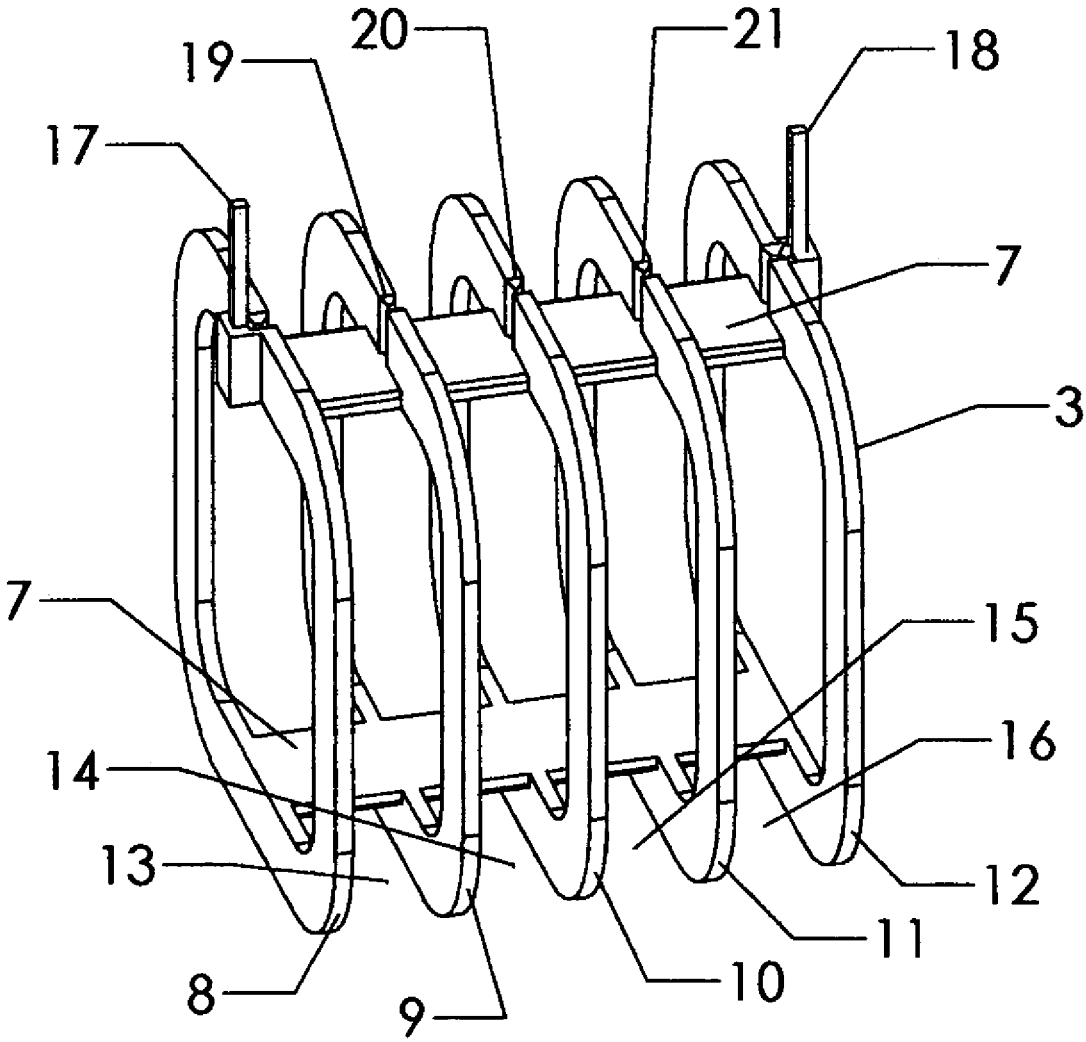
FIG. 2 is an isometric view of a preferred embodiment of the invention showing the frame providing a plurality of winding bays for the high voltage secondary winding shown in FIG. 1.

FIG. 2 is an isometric view of the frame 3 shown in FIG. 1. The frame 3 includes two flange supports 7, five flanges 8, 9, 10, 11, and 12 that define four incomplete winding bays 13, 14, 15, and 16 as no barrel is provided to provide a complete winding bay. Two pins 17 and 18 for termination of the ends of the secondary winding 5 (not shown in FIG. 2), and cross-over slots 19, 20, and 21 to allow the secondary winding 5 (not shown in FIG. 2) to connect between adjacent winding bays are also shown. While cross-over slots are shown in flanges 9, 10, and 11, they need not be present as other construction methods available in the transformer industry such as winding over the edge of a flange may be used to connect adjacent winding bays. The frame 3 is comprised of nylon or any other common insulation material used in the transformer bobbin industry and the pins 17 and 18 are comprised of phosphor bronze or any other common conductive terminal material also used in the transformer bobbin industry. By using nylon for the frame 3, the wall thickness of the frame 3 is typically around 1/32 of an inch thick and significantly thicker than the thin film insulation materials available for the stick wound transformer industry.

Figure 3:
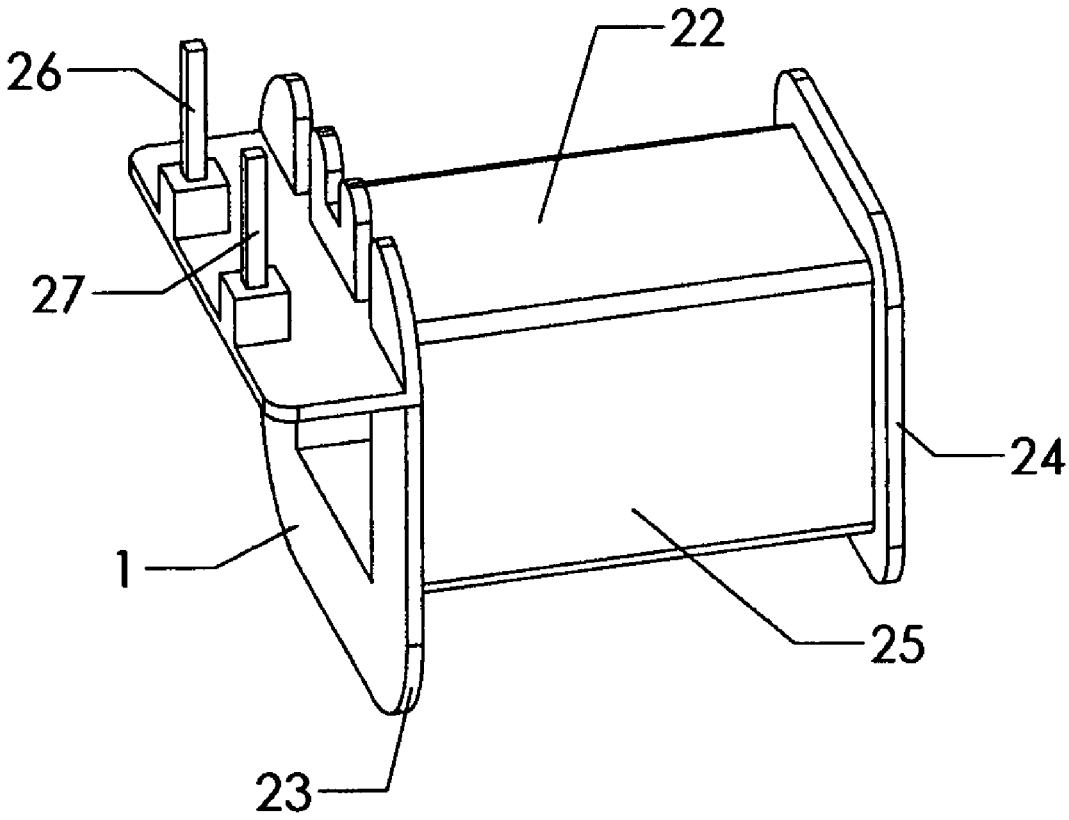
FIG. 3 is an isometric view of a preferred embodiment of the invention showing the bobbin used for the primary winding shown in FIG. 1.

FIG. 3 is an isometric view of the bobbin 1 shown in FIG. 1. The bobbin 1 is a typical transformer bobbin including a square shaped barrel 22, two flanges 23 and 24 at each end of the barrel 22, where the barrel 22 and flanges 23 and 24 create a winding bay 25. The bobbin 1 is also provided with pins 26 and 27 for termination of the ends of the primary winding 2 (not shown in FIG. 3). While the barrel 22 is square in shape, the shape may be rectangular, round, or any other shape required to fit over a core shape found in the transformer industry. The bobbin 1 is comprised of nylon or any other common insulation material used in the transformer bobbin industry and the pins 26 and 27 are comprised of phosphor bronze or any other common conductive terminal material also used in the transformer bobbin industry.

Figure 4:
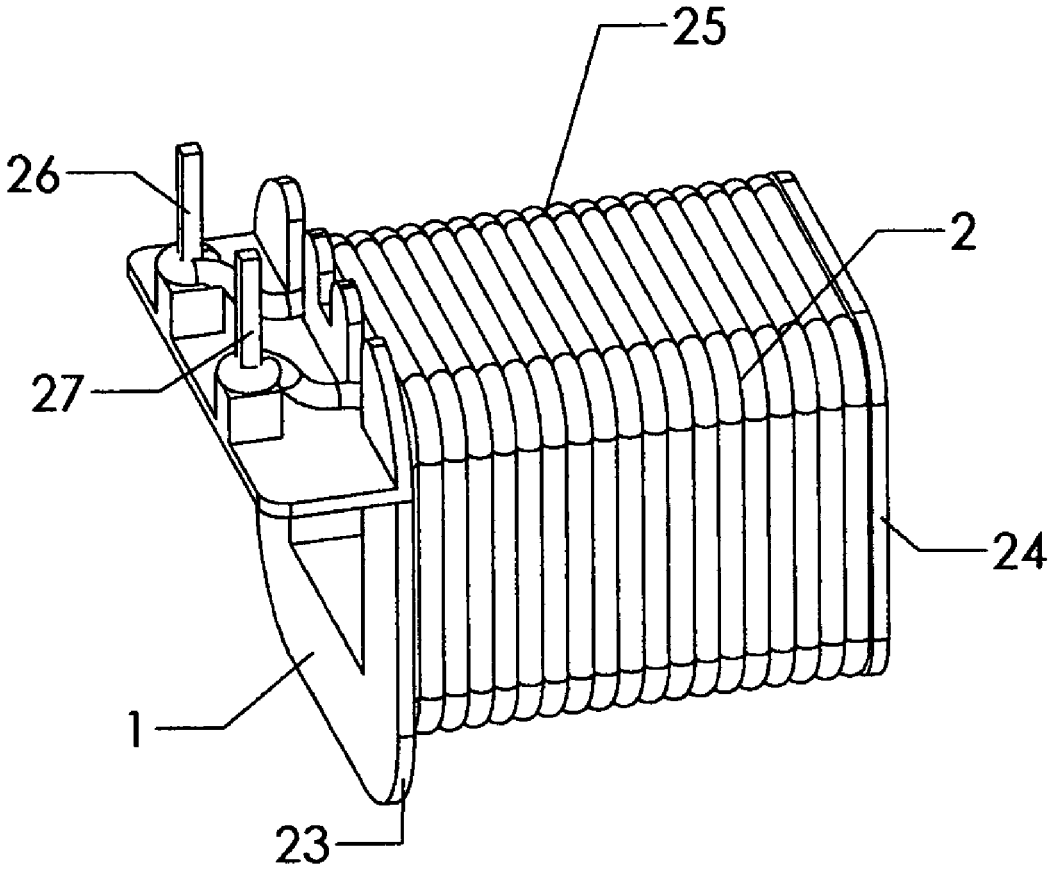
FIG. 4 is an isometric view of a preferred embodiment of the invention showing the primary winding shown in FIG. 1 wound around the bobbin used for the primary winding shown in FIG. 3.

FIG. 4 is an isometric view of the bobbin 1 shown in FIG. 3 with the primary winding 2 wound around the outside perimeter of the barrel 22 (not shown as the barrel is hidden by the primary winding 2) between the flanges 23 and 24 in the winding bay 25 with the ends of the primary winding 2 terminated at pins 26 and 27. The primary winding 2 may be wound in a single layer or multiple layers in the winding bay 22 and is comprised of magnet wire common in the transformer industry. While the ends of the primary winding 2 are terminated or electrically and mechanically connected to the pins 26 and 27, the pins are not necessary as several other methods of connecting the ends of the primary winding 2 to an external circuit are available in the transformer industry.

Figure 5:
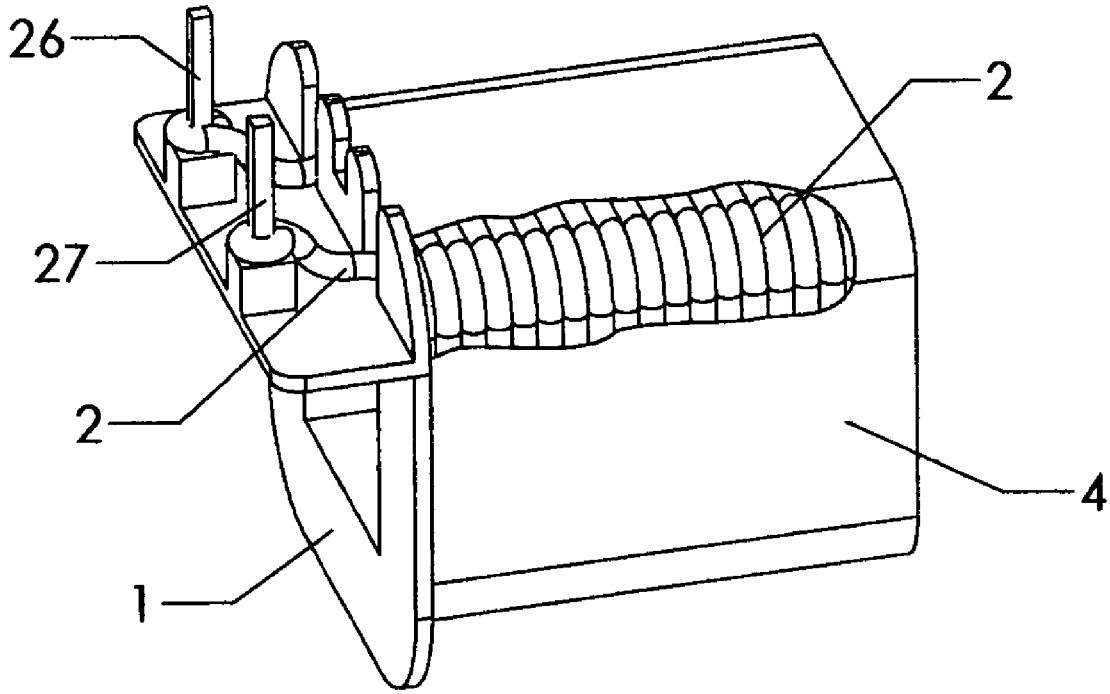
FIG. 5 is an isometric view of a preferred embodiment of the invention showing the primary winding wound around the bobbin shown in FIG. 4 with the thin insulation layer (cutaway) used for the barrel to wind the secondary winding assembled over the primary winding.

FIG. 5 is an isometric view of the bobbin 1 and primary winding 2 shown in FIG. 4 with the thin insulation layer 4 assembled around the outside of the primary winding 2 and cutaway to show the primary winding 2. The thin insulation layer 4 is comprised of mylar tape ranging in thickness from one thousandth to several thousandths of an inch thick depending on the dielectric requirements between the primary winding 2 and the secondary winding 5 (not shown in FIG. 5) as determined by someone skilled in the art of transformer design. While the thin insulation layer 4 is comprised of mylar tape, other thin materials such as paper or another type of thin film insulation available in the stick wound transformer industry may be used and need not be self-adhesive, again as determined by someone skilled in the art of transformer design. Also, as the thinnest film type insulation material commonly available today in the transformer is one thousandth of an inch thick, thinner insulation materials may also be used provided they provide the dielectric strength needed between the primary and secondary windings. The thin insulation layer 4 may also consist of more than one layer of a thin material. For example, several layers of a one thousandth inch thick insulation film may be used in place of a single layer several thousandths of an inch thick. Also, to avoid a gap in the thin insulation layer 4, the thin insulation may overlap itself as it is wrapped around the primary winding 2 such that the thin insulation layer 4 is thicker around part of the primary winding 2. In addition to thin film insulations such as paper and mylar, the thin insulation layer 4 may also be comprised of a coating such as varnish or conformal coating over the primary winding 2 as these types of thin insulation are also available in the transformer industry.

Figure 6:
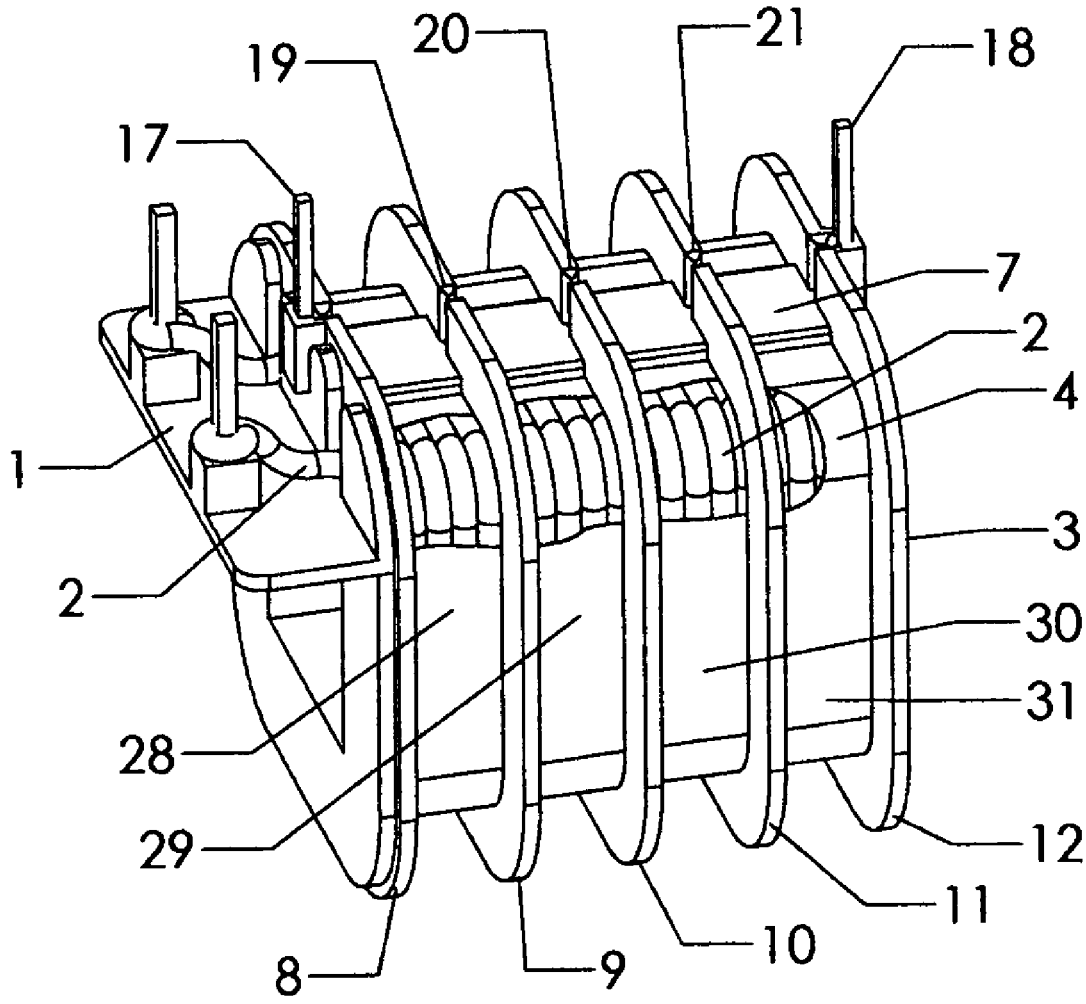
FIG. 6 is an isometric view of a preferred embodiment of the invention showing the primary winding wound around the bobbin and thin insulation layer (cutaway) used for the barrel to wind the secondary winding shown in FIG. 5 with the frame shown in FIG. 2 assembled over the thin insulation layer to provide a plurality of winding bays for a high voltage secondary winding with thin winding bay barrels between the primary and secondary windings.

FIG. 6 is an isometric view of the bobbin 1 and primary winding 2 with the thin insulation layer 4 (cutaway) shown in FIG. 5 with the frame 3 shown in FIG. 2 assembled over the bobbin 1, primary winding 2, and thin insulation layer 4 shown in FIG. 5. While the frame 3 and thin insulation layer 4 separate do not provide a plurality of winding bays, when assembled as shown in FIG. 6, four complete windings bays 28, 29, 30 and 31 are formed where the frame 3 provides flanges 8, 9, 10, 11, and 12 and the thin insulation layer 4 provides the barrel for each of the four winding bays.

Figure 7:
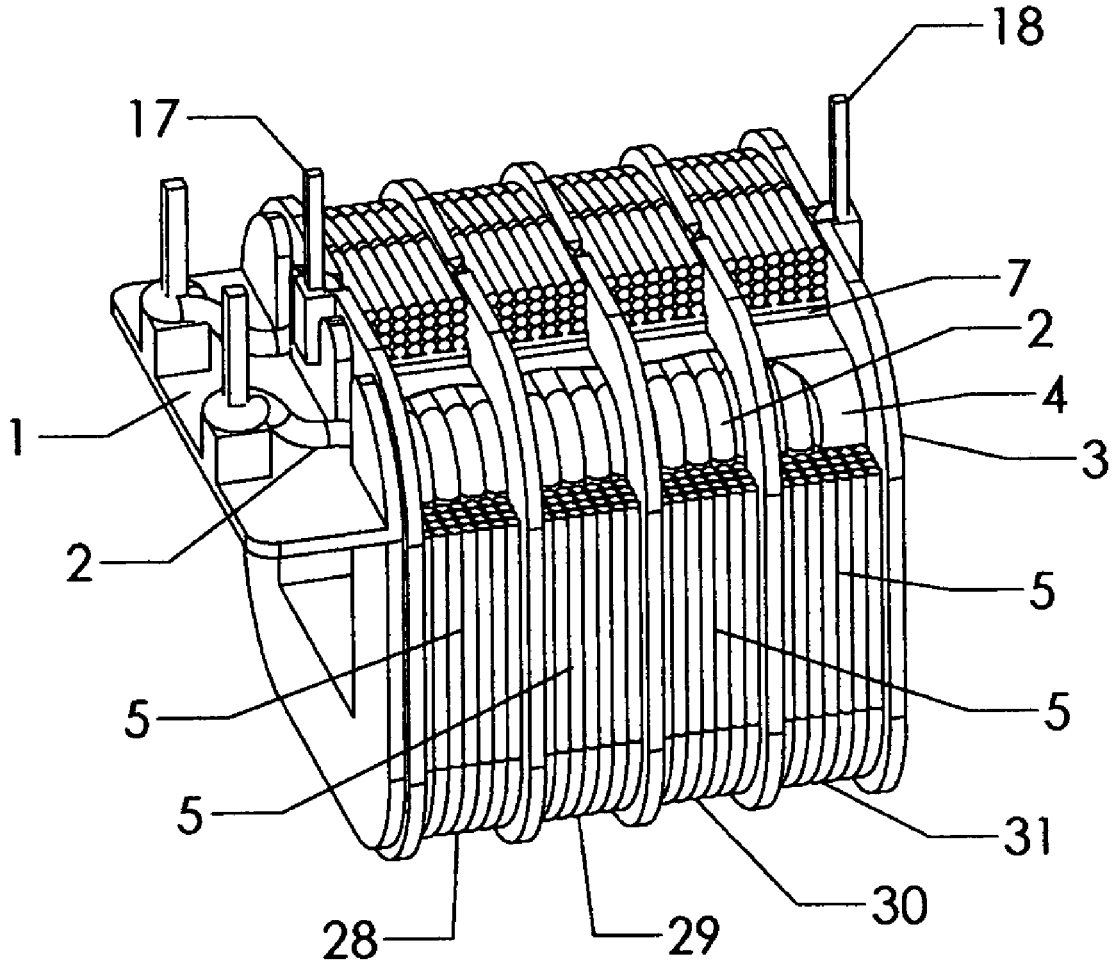
FIG. 7 is an isometric view of a preferred embodiment of the invention showing the plurality of secondary winding bays provided by the frame and thin insulation layer shown in FIG. 6 with a high voltage secondary winding.

FIG. 7 is an isometric view of the bobbin 1, primary winding 2 with the thin insulation layer 4 (cutaway), and frame 3 assembled over the bobbin 1, primary winding 2, and thin insulation layer 4 shown in FIG. 6 along with the secondary winding 5 wound in each of the complete winding bays 28, 29, 30 and 31. The secondary winding 5 is comprised of magnet wire common in the transformer industry and the ends of the secondary winding 5 are terminated at pins 17 and 18. While the flange supports 7 are the same thickness as the barrel of a typical multi-winding bay bobbin barrel, are significantly thicker than the thin insulation layer 4 and are located at the bottom of the four complete winding bays 28, 29, 30 and 31, the flange supports 7 only cause the secondary winding 5 to be held away from the primary winding 2 along a short distance around the perimeter of the barrel or thin insulation layer 4 allowing several of turns from the primary winding 2 to be in close proximity with several of the turns from the secondary winding 5 along a significant distance around the perimeter of the secondary winding barrel or thin insulation layer 4. The close proximity of the primary winding 2 to the secondary winding 5 along a significant distance around the perimeter of the thin insulation layer 4 separating the primary winding 2 from the secondary winding 5 provides a significant increase in the coupling coefficient in a high voltage, step-up, high current DC pulse type transformer for use in a high current pulse type application such as a capacitive discharge type circuit where the core is pushed beyond saturation and where the coupling coefficient becomes significantly dependent on the primary winding's physical proximity to the secondary winding.

While the frame 4 and thin insulation film 3 provide four complete winding bays 28, 29, 30 and 31, the number of winding bays and the size of each individual winding bay may vary depending on the dielectric strength of the magnet wire used for the secondary winding 5 and the output voltage potential of the secondary winding 5 as determined by someone skilled in the art of high voltage transformer design. While the ends of the secondary winding 5 are terminated at pins 17 and 18, the pins 17 and 18 are not necessary as several other methods of terminating the ends of the secondary winding 5 are available in the transformer industry. Also, while two flange supports 7 are provided, the size and number of flange supports may also vary depending on the mechanical strength needed to hold the flanges in place during assembly of the transformer.

Figure 8:
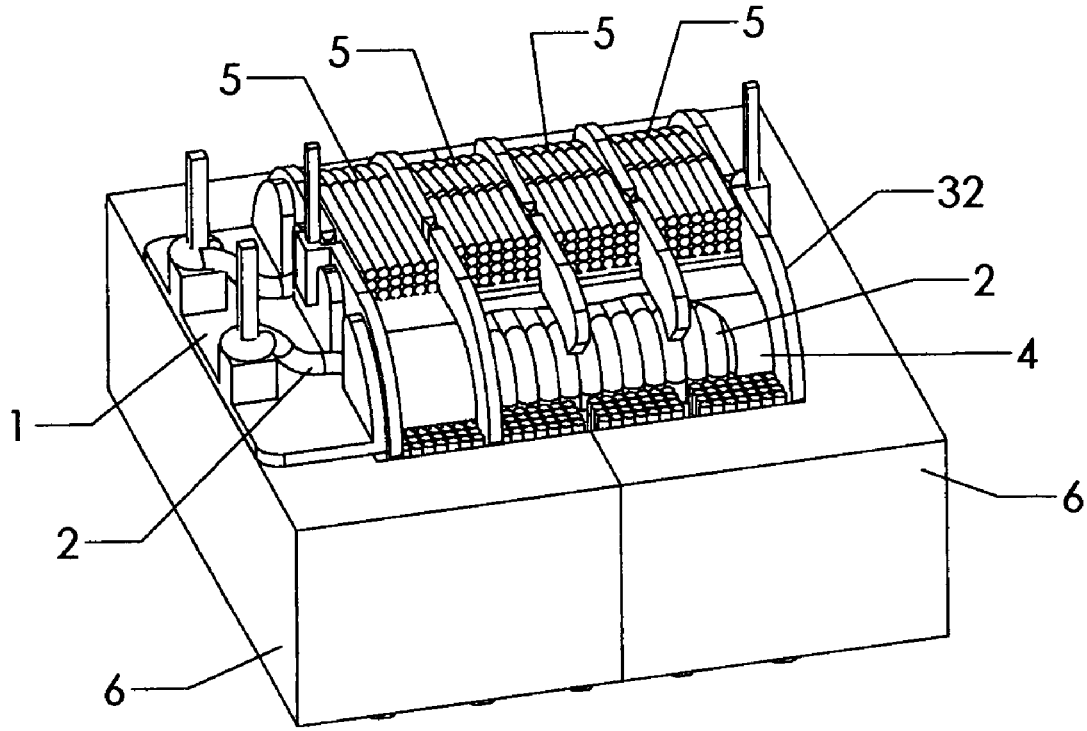
FIG. 8 is an isometric view of an alternate embodiment of the invention showing an alternate frame providing a plurality of winding bays with a high voltage second winding (cutaway), the separate thin insulation layer (cutaway) providing the barrel for the part of secondary winding, an alternate flange configuration for providing secondary winding bays, and the primary winding in close proximity to the secondary winding along a significant distance around the perimeter of the barrel used for the secondary winding.

FIG. 8 is an isometric view of an alternate embodiment of the high voltage, step-up, high current DC pulse type transformer invention that increases the coupling coefficient through close proximity of the primary winding turns and secondary winding turns. In FIG. 8, a completely assembled transformer is shown with a bobbin 1, primary winding 2, an alternate frame 32 and separate thin insulation layer 4 combined to provide a form for winding the secondary winding 5 in close proximity to the primary winding 2. As is FIG. 1, the secondary winding 5 has on output voltage potential that is greater than the primary winding 2 such that the transformer is considered a step-up type transformer and the secondary winding 5 is a high voltage winding of sufficient output voltage potential to cause breakdown in the coating on the magnet wire used for the secondary winding 5 if the secondary winding is not provided with a means to distribute the output voltage potential such as distributing the output voltage between multiple winding bays or distributing the output voltage between multiple winding layers with insulation between each winding layer. Also shown in FIG. 8 is a typical transformer core 6 inserted into the openings at each end of the bobbin 1. The primary winding 2 is for connection to a typical high current DC pulse type circuit (not shown) such as a capacitive discharge type circuit where the peak DC pulse current is significantly higher than the peak DC pulse current level needed to saturate the core 6.

Figure 9:
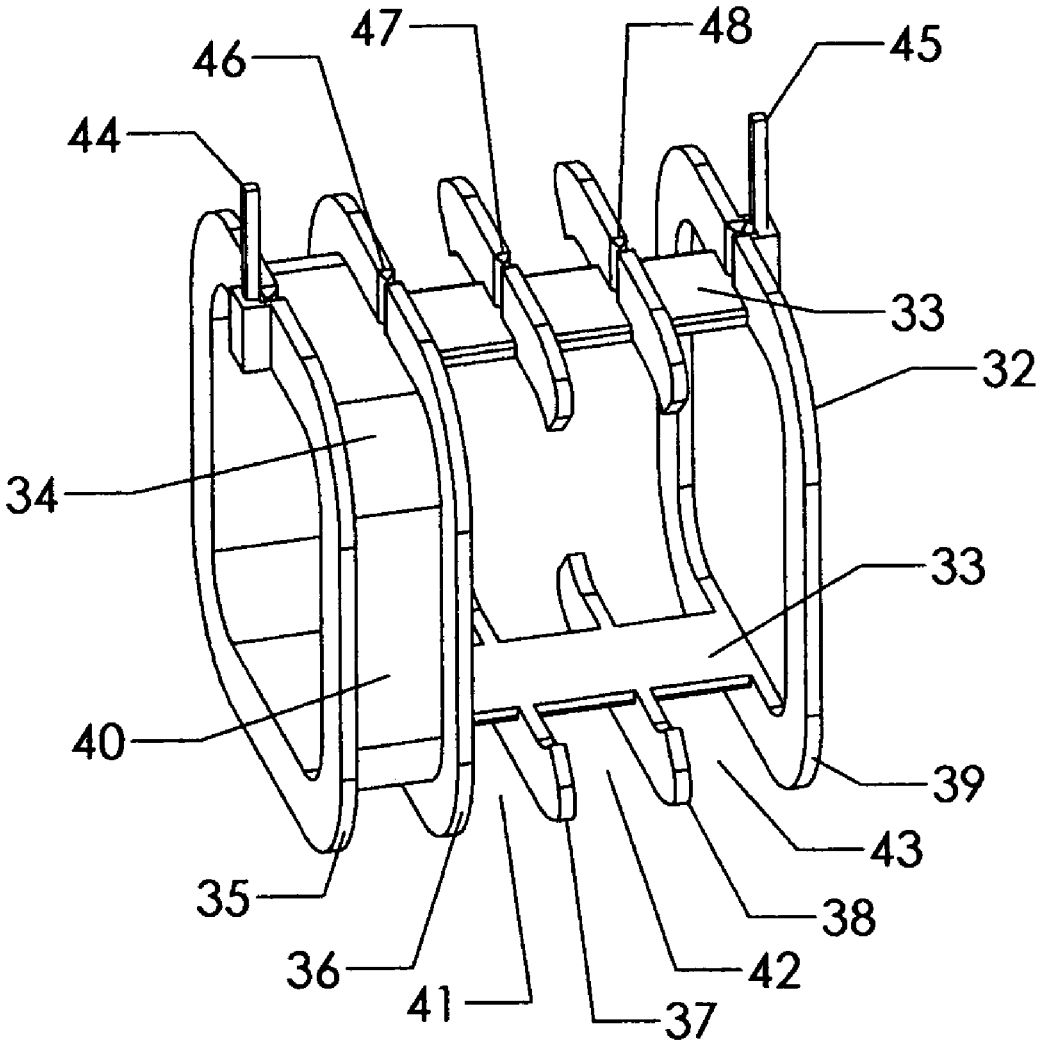
FIG. 9 is an isometric view of an alternate embodiment of the invention showing the alternate frame shown in FIG. 8 providing a plurality of winding bays for the high voltage secondary winding.

FIG. 9 is an isometric view of the alternate frame 32 shown in FIG. 8. The alternate frame 32 includes two flange supports 33, a barrel 34, five flanges 35, 36, 37, 38, and 39 where flanges 35 and 36 along with the barrel 34 form a complete winding bay 40 and where flanges 36, 37, 38, and 39 define three incomplete winding bays 41, 42, and 43 as no barrel is provided to provide a complete winding bay. Two pins 44 and 45 for termination of the ends of the secondary winding 5 (not shown in FIG. 9), and cross-over slots 46, 47, and 48 to allow the secondary winding 5 (not shown in FIG. 9) to connect between adjacent winding bays are also shown. As in the preferred embodiment, while cross-over slots are shown, they need not be present as other construction methods available in the transformer industry may be used to connect adjacent winding bays. The alternate frame 32 is comprised of nylon or any other common insulation material used in the transformer bobbin industry and the pins 44 and 45 are comprised of phosphor bronze or any other common conductive terminal material also used in the transformer bobbin industry. By using nylon for the alternate frame 32, the wall thickness of the alternate frame 32 is typically around 1/32 of an inch thick and significantly thicker than the thin film insulation materials available for the stick wound transformer industry.

Figure 10:
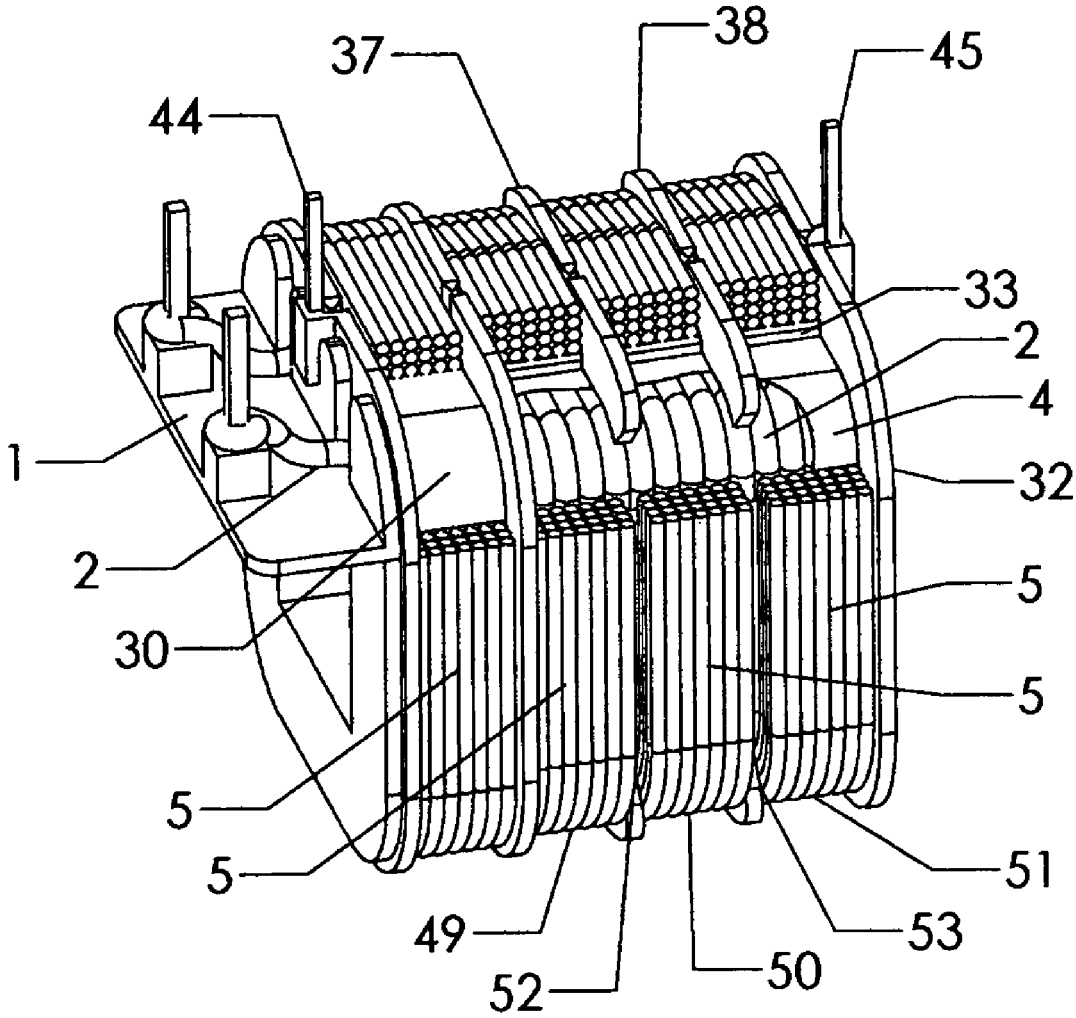
FIG. 10 is an isometric view of an alternate embodiment of the invention showing the plurality of secondary winding bays provided by the alternate frame shown in FIG. 9. and thin insulation layer shown in FIG. 8 with a high voltage secondary winding.

FIG. 10 is an isometric view of the bobbin 1, primary winding 2 and the thin insulation layer 4 (cutaway) shown in FIG. 5, and the alternate frame 32 shown in FIG. 9 assembled over the bobbin 1, primary winding 2, and thin insulation layer 4, along with the secondary winding 5 wound in each of the complete winding bays 30, 49, 50, and 51. As shown, three complete winding bays 49, 50, and 51 are formed from the alternate frame 32 and thin insulation layer 4 as the barrel of the three winding bays 49, 50, and 51 while the fourth complete winding bay 30 is formed completely by the alternate frame 32 similar to a typical high voltage multi-winding bay bobbin found in the transformer industry. While the construction using a combination of winding bays with a thin barrel (thin insulation layer) and winding bays formed using a typical bobbin construction with a thick barrel is not preferred, it may be necessary to use a typical thick wall section barrel in some of the winding bays depending on the dielectric strength needed between the primary winding 2 and secondary winding 5 as determined by someone skilled in the art of high voltage transformer design.

Also shown in FIG. 10 are flanges 37 and 38 with openings 52 and 53 such that the flanges 37 and 38 do not form a barrier between adjacent winding bays the entire perimeter high voltage secondary winding 5. While windings from adjacent winding bays are allowed to wind into an adjacent winding, the secondary winding 5 is still provided with adequate separation between winding bays to prevent dielectric breakdown in the coating on the magnet wire used for the secondary winding 5 as the winding in winding bays 49 and 51 are separated by winding in winding bay 50.

While some of the winding bays as shown in FIG. 10 may be provided with a thick barrel using a barrel with a thick wall section similar to a typical high voltage multi-winding bay bobbin, the use of one or more winding bays provided with a barrel consisting of several thousandths thick or less provides a close proximity between some of the winding turns of the primary winding 2 and some of the winding turns of the secondary winding 5 along a significant distance around the perimeter of the thin insulation layer 4 separating the primary winding 2 from the secondary winding 5 such that a significant increase in the coupling coefficient is provided in a high voltage, step-up, high current DC pulse type transformer for use in a high current pulse type application such as a capacitive discharge type circuit where the core is pushed beyond saturation and where the coupling coefficient becomes significantly dependent on the primary winding's physical proximity to the secondary winding.

While several preferred embodiments of the present invention have been described, it should be understood that various changes, adaptations, and modifications may be made therein without departing from the spirit of the invention and the scope of the appended claims.

What is claimed is:

1. A high current DC pulse type transformer for connection to a high pulse current or capacitive discharge type circuit where the transformer is provided with a primary bobbin, a primary winding, a secondary winding frame, a secondary winding barrel, a secondary winding, and a core where:

the primary and secondary windings are wound around a common leg of the transformer's core with the primary and secondary windings wound one winding outside the other;

the primary winding is wound around said primary bobbin;

the peak current through said primary winding is significantly higher than the current necessary to saturate said core;

the transformer is a step-up type transformer;

the transformer's duty cycle is significantly low;

the secondary winding barrel is coaxially around the outside of said primary winding;

the secondary winding frame comprises three or more flanges supported longitudinally along one or more flange supports and coaxially around the outside of said secondary winding barrel with said secondary winding barrel exposed between said flanges along part of the secondary winding barrel perimeter in one or more winding bays;

the secondary winding is wound around said secondary winding bay barrel and said secondary winding bay flange supports in two or more winding bays;

the secondary winding is a high voltage winding provided in two or more winding bays such that the voltage potential across each winding bay is less than output voltage potential of the secondary winding; and where one or more secondary winding bays are provided with an insulated winding bay barrel that physically separates the primary and secondary windings by several thousandths of an inch or less along at least part of the winding barrel's winding perimeter.

2. A transformer of claim 1 where the flanges are injection molded.

3. A transformer of claim 1 where the insulated winding bay barrel that physically separates the primary and secondary windings is comprised of an insulation film such as paper or mylar.

4. A transformer of claim 1 where the insulated winding bay barrel that physically separates the primary and secondary windings is comprised of a coating such as varnish or conformal coating.

5. A transformer of claim 1 where the insulated winding bay barrel that physically separates the primary and secondary windings provides adequate dielectric strength to prevent breakdown between the primary and secondary windings.

6. A transformer of claim 1 where the winding bays for the high voltage secondary winding are defined by flanges present along only part of the secondary barrel's winding perimeter.

* * * * *